United States Patent [19]

Murdick et al.

[11] Patent Number: 4,535,891

[45] Date of Patent: Aug. 20, 1985

[54] TACO TRAY

[75] Inventors: Brian K. Murdick, Columbus; William H. Haase, Dublin, both of Ohio

[73] Assignee: International Paper Company, New York, N.Y.

[21] Appl. No.: 525,751

[22] Filed: Aug. 23, 1983

[51] Int. Cl.[3] ..... B65D 1/34; B65D 85/36

[52] U.S. Cl. ..... 206/564; 229/DIG. 13; 426/115; D7/37

[58] Field of Search ..... 206/507, 564; 229/2.5, 229/DIG. 13; D7/37, 72, 76, 411; 426/115, 128

[56] References Cited

U.S. PATENT DOCUMENTS

| | | | |
|---|---|---|---|
| D. 160,088 | 9/1950 | Hutzler | D7/72 |
| D. 216,637 | 2/1970 | Hermalin | D7/76 |
| D. 217,593 | 5/1970 | Loren | D7/37 |
| D. 263,191 | 3/1982 | Moore | D7/37 |
| D. 263,786 | 4/1982 | Kohan | D7/105 |
| D. 266,816 | 11/1982 | Schupp | D7/27 |
| D. 267,143 | 12/1982 | Gessing | D7/76 |
| 1,423,001 | 7/1922 | Maxwell | D7/37 |
| 2,023,470 | 12/1935 | Hart | 229/2.5 R |
| 3,331,626 | 7/1965 | Kaufman | 294/16 |
| 3,355,082 | 11/1965 | Wood | 229/16 R |
| 3,384,263 | 5/1968 | Bernstein | D7/76 X |
| 3,446,416 | 5/1969 | Epstein | 229/31 R |
| 3,575,337 | 4/1971 | Bernhardt | 229/D13 |
| 3,610,512 | 5/1971 | Hermalin | 229/32 |
| 3,929,564 | 12/1975 | Reifers | 162/224 |
| 3,937,389 | 2/1976 | Wind | 229/2.5 R |
| 4,125,243 | 11/1978 | Liptak | 248/473 |
| 4,270,660 | 6/1981 | Putt | 211/13 |
| 4,291,805 | 9/1981 | Seeley | 206/563 |
| 4,294,371 | 10/1981 | Davis | 229/2.5 R |

*Primary Examiner*—William T. Dixson, Jr.
*Assistant Examiner*—Brenda J. Ehrhardt
*Attorney, Agent, or Firm*—Walt Thomas Zielinski

[57] ABSTRACT

A tray for supporting a taco in an upright position. The tray may be formed by molding or die forming. The midportion of the tray sides contacts the taco to hold it upright, while the ends of the tray are enlarged to inhibit tipping over of the tray and taco.

1 Claim, 4 Drawing Figures

FIG. 1
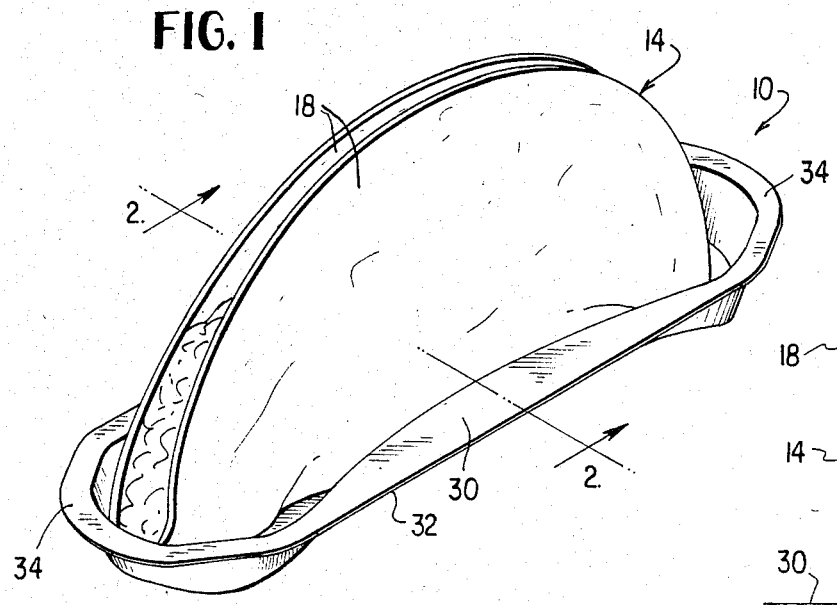
FIG. 2
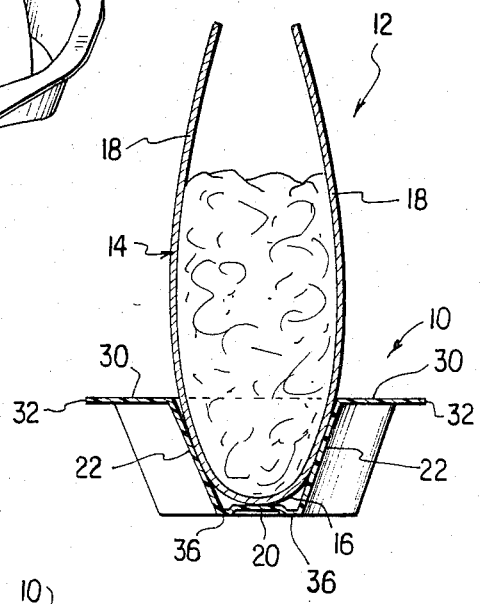
FIG. 3
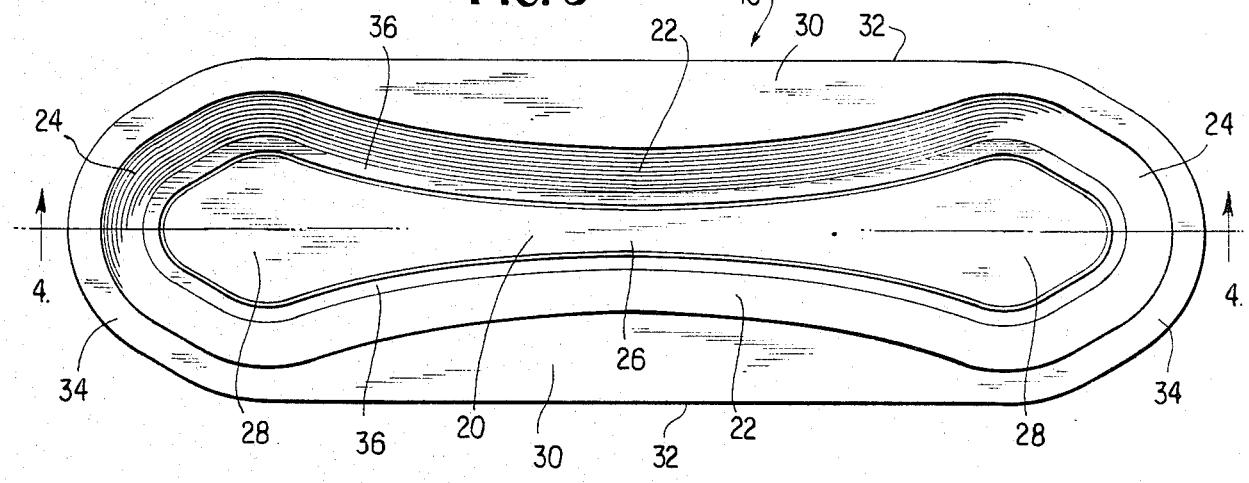
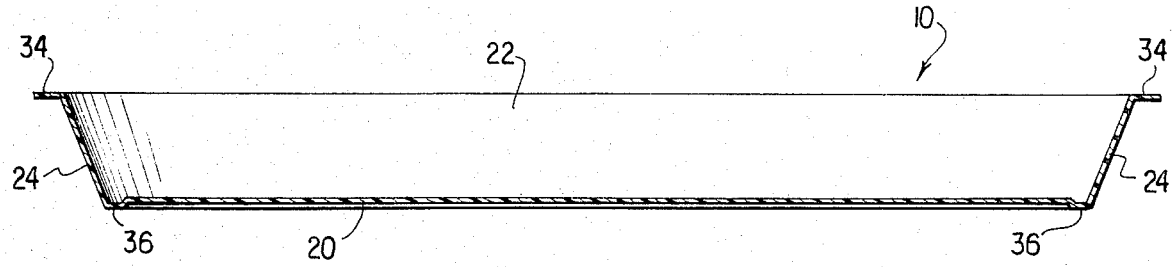
FIG. 4

TACO TRAY

This invention relates to a tray or holder for a foodstuff, and more particularly to a tray for holding a taco in an upright position. A taco is a sandwich made of a tortilla rolled up with or folded over a filling and then usually fried.

Numerous types of trays and other holders have been developed for holding food products for handling and eating. U.S. Pat. No. 4,270,660 to Putt relates to a holder for edible products such as tacos and the like. In its simplest form, this holder is formed of two shaped sheets of plastic which are separatly formed and then bonded together. The holder is not intended for one time use.

Reifers U.S. Pat. No. 3,929,564 relates to a tray which is formed of dried pulp. This tray, however, has the deficiency of not being of a configuration to grip a taco to hold the taco in an upright position.

In a like manner, U.S. Pat. No. 3,446,416 granted to Epstein discloses a sandwich holder wherein the sides thereof are parallel, yet does not yield the necessary griping action to hold a taco in an upright position while providing the necessary supporting base area.

It is known to provide other types of food holders wherein a member is gripped in one's fingers and utilized to clamp a food product for handling during eating. It is also known to provide special packages in which food products may be completely encased.

In accordance with the practice of this invention, a tray is particularly configured for holding a taco in an upright position, providing the necessary supporting area to prevent the tray and taco from overturning.

IN THE DRAWINGS

FIG. 1 is a top perspective view of the tray having positioned therein a taco and shows the general details of the tray.

FIG. 2 is an enlarged fragmentary transverse sectional view taken generally along the line 2—2 of FIG. 1 and shows the relationship between the taco and the tray. FIG. 3 is an enlarged plan view of the tray with the taco removed therefrom. FIG. 4 is an enlarged longitudinal sectional view taken through the tray generally along the line 4—4 of FIG. 3.

Referring now to the drawings, it will be seen that there is illustrated in FIG. 1 a tray formed in accordance with this invention, the tray being generally denoted by the numeral 10 and being particularly adapted for supporting a taco in an upstanding position, the taco being generally indentified by the numeral 12.

A taco, such as taco 12, includes an edible baked shell 14 of a dough which is initially generally circular in outline, and has been folded so as to have a rounded base 16 and two upstanding sides 18. The taco shell 14 may be filled with a selection of food products including meat, lettuce, tomatoes, etc.

A taco is not easily handled due to the open ends and top thereof. Unless the shell of the taco is upright, the food product or filling placed within the shell has a tendency to escape from the shell interior. Accordingly, a special tray is desirable for holding the taco.

It is to be understood that a taco is relatively narrow and if a tray were made to fit the taco, for the full length of the taco, the tray would be unstable. Accordingly, the tray 10 of this invention has an adequately large base so as to support the taco and the tray against overturning, while at the same time has side walls with spaced portions thereof to grip the taco and prevent the taco from tilting within the tray.

Most specifically, the tray 10 includes a base 20 from which extends upwardly side walls 22 and end walls 24. As is best shown in FIG. 3, the end walls 24 are generally semi-circular in outline while the side walls 22 are bowed toward each other. The net result is that the central portions of the side walls 22 are relatively closely spaced, so that they engage opposite sides of a taco, as is shown in FIG. 2. On the other hand, because of the curvature of these side walls, the base 20 has a narrow central portion 26 and relatively wide end portions 28. Thus, while the central portions of the side walls 22 are closely spaced for the purpose of gripping the taco, the base 20 possesses sufficient width at the ends to prevent the tray from easily overturning.

The side walls 22 and the end walls 24 are reinforced by a surrounding peripheral flange 30. The flange 30 has spaced parallel edges 32 and generally semi-circular end portions 34. The flange 30 is thus generally rectangular in outline while the base 20 has the general shape of a bone or bar bell.

Further, the tray 10 may be reinforced by providing in the base 20 a peripheral depending rib 36 as is clearly shown in FIGS. 2 and 4. The rib 36 both provides reinforcement for the tray and further defines a seating surface. The tray may be formed of a molded plastic sheet, or the tray may be formed of paper pulp and the like From a consideration of FIGS. 2 and 3 of the drawings, it will be apparent that the ratio of the length of the cavity to the narrowest distance between the inwardly bowed side walls 22 is greater than a factor of 3. Further, it will also be observed that the width of the cavity ends 28 is at least twice the width of the narrowest portion 26 of the cavity. Also, particularly from a consideration of FIG. 2, it will be observed that the widest portions of offset peripheral rib 36 are wider than the widest portions of the taco 14. This relationship inhibits tipping over of the tray and taco assembly.

We claim:

1. A tray and taco assembly for holding a taco in an upright position, said tray comprising a base, integral side and end walls extending upwardly from said base and in combination with said base defining an elongated cavity adapted to receive a taco, and a reinforcing flange extending around one top of said cavity and integrally connected to said top and end walls, the side walls being inwardly bowed so that longitudinally central portions thereof are narrowed with respect to the opposite longitudinal ends of said cavity to thereby form a support for a taco, the side walls diverging upwardly from said base for wedgingly receiving therebetween a taco, the side walls at the ends of the cavity being wider than the side walls at the longitudinally central part of the cavity, wherein said base is enlarged at ends thereof to provide a stable support against overturning of the tray when a taco is positioned in it, the end walls being rounded in outline, the reinforcing flange being generally rectangular in peripheral outline, the base being reinforced by a downwardly offset peripheral rib, said rib also defining the supporting surface for said base, the ratio of the length of the cavity to the narrowest distance between the inwardly bowed side walls being greater than a factor of three, the ratio of the width of the widest part of the base ends of the cavity to the width of the narrowest part of the cavity being at least a factor of two, a taco in the cavity and wedgingly engaged along a portion of its sides by at least the narrowest cavity portions defined by the inwardly bowed side walls, a portion of the taco extending above the top of the cavity, wherein the widest portions of the downwardly offset peripheral base rib, considered transversely of the longitudinal axis of the cavity, are wider than the widest portion of the taco, to thereby inhibit tipping over of the tray and taco assembly.

* * * * *